US012279694B2

(12) United States Patent
Heuer et al.

(10) Patent No.: US 12,279,694 B2
(45) **Date of Patent: *Apr. 22, 2025**

(54) TOWEL BAR WITH INTEGRATED ROBE HOOK

(71) Applicant: ASSA ABLOY Americas Residential Inc., New Haven, CT (US)

(72) Inventors: Darin Lane Heuer, Anaheim Hills, CA (US); Victor Tung, Rowland Heights, CA (US); Jan Christopher van Leyen, Irvine, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/396,936

(22) Filed: Dec. 27, 2023

(65) Prior Publication Data

US 2024/0252000 A1 Aug. 1, 2024

Related U.S. Application Data

(63) Continuation of application No. 17/668,731, filed on Feb. 10, 2022, now Pat. No. 11,896,168, which is a continuation of application No. 17/077,566, filed on Oct. 22, 2020, now Pat. No. 11,246,458, which is a continuation of application No. 15/629,512, filed on Jun. 21, 2017, now Pat. No. 10,813,508.

(60) Provisional application No. 62/353,319, filed on Jun. 22, 2016.

(51) Int. Cl.

| | |
|---|---|
| ***A47K 10/10*** | (2006.01) |
| ***A47B 61/02*** | (2006.01) |
| ***A47G 25/06*** | (2006.01) |
| ***A47K 10/04*** | (2006.01) |

(52) U.S. Cl.

CPC ..... *A47B 61/02* (2013.01); *A47G 25/0685* (2013.01); *A47K 10/04* (2013.01); *A47K 10/10* (2013.01)

(58) Field of Classification Search

CPC .... A47K 10/10; A47K 10/04; A47K 2201/02; A47B 61/02; A47G 25/0685; D06F 57/12

See application file for complete search history.

(56) References Cited

U.S. PATENT DOCUMENTS

| | | | |
|---|---|---|---|
| 1,219,736 | A | 3/1917 | Hawley |
| 1,262,608 | A | 4/1918 | Wheary |
| 1,377,444 | A | 5/1921 | Shoemaker |
| 1,428,554 | A | 9/1922 | Osterweil |
| 1,489,733 | A | 4/1924 | Birbaum |
| 1,574,705 | A | 2/1926 | Sessions |

(Continued)

FOREIGN PATENT DOCUMENTS

| | | | |
|---|---|---|---|
| GB | 908935 | A * | 10/1962 |
| GB | 2429902 | | 3/2007 |

*Primary Examiner* — Kimberley S Wright

(74) *Attorney, Agent, or Firm* — Merchant & Gould P.C.

(57) ABSTRACT

A towel bar includes a retractable and extendable robe hook. The robe hook may be formed in a wall-mounted first base joined by a towel bar to a wall-mounted second base. A shaft may be extended from the base to reveal the robe hook. When extended, the robe hook provides a location from which objects may be hung. When not needed, the robe hook may be pushed into the base and reside within an internal cavity, thereby concealed from view.

20 Claims, 6 Drawing Sheets

(56) References Cited

U.S. PATENT DOCUMENTS

| | | | |
|---|---|---|---|
| 1,595,518 | A | 8/1926 | Harrison |
| 2,091,931 | A | 8/1937 | Levine |
| 2,229,182 | A | 1/1941 | Meyers |
| 2,246,137 | A | 6/1941 | Levine |
| 2,473,771 | A | 6/1949 | Slater |
| 2,587,111 | A | 2/1952 | Cashen |
| 3,784,020 | A | 1/1974 | Steiner |
| 3,981,404 | A | 9/1976 | Goeke |
| 4,771,895 | A | 9/1988 | Steiner |
| 4,789,069 | A | 12/1988 | Baus |
| 5,190,170 | A | 3/1993 | Steiner |
| 6,012,692 | A | 1/2000 | Meck |
| 6,024,231 | A | 2/2000 | Bates |
| 6,609,689 | B1 | 8/2003 | Knapp |
| D574,652 | S | 8/2008 | Zhang |
| 7,571,532 | B2 | 8/2009 | Zimmerman |
| 8,671,545 | B1 | 3/2014 | Zimmerman |
| 9,271,615 | B1 | 3/2016 | Stephens |
| 9,661,946 | B2 | 5/2017 | Stammnitz et al. |
| 10,111,559 | B2 | 10/2018 | Edwards |
| 10,808,921 | B2 | 10/2020 | Heuer et al. |
| 10,813,508 | B2 | 10/2020 | Heuer et al. |
| 11,246,458 | B2 | 2/2022 | Heuer et al. |
| 11,896,168 | B2 | 2/2024 | Heuer |
| 2002/0074301 | A1 | 6/2002 | Lai |
| 2007/0272637 | A1 | 11/2007 | Rigas |
| 2009/0119879 | A1 | 5/2009 | Rigas |
| 2009/0223912 | A1 | 9/2009 | Chen |
| 2009/0294389 | A1 | 12/2009 | Ward |
| 2010/0314978 | A1 | 12/2010 | Manalang |
| 2012/0080394 | A1 | 4/2012 | Shorty |
| 2012/0153107 | A1 | 6/2012 | Edwards |
| 2014/0026402 | A1 | 1/2014 | Austin, III et al. |
| 2014/0151519 | A1 | 6/2014 | Zimmerman |
| 2016/0286995 | A1 | 10/2016 | Stammnitz et al. |

* cited by examiner

SECTION A:A

TOWEL BAR WITH INTEGRATED ROBE HOOK

CROSS REFERENCE TO RELATED APPLICATIONS

This application is a continuation of U.S. patent application Ser. No. 17/668,731, now U.S. Pat. No. 11,896,168, filed Feb. 10, 2022, which is a continuation of U.S. patent application Ser. No. 17/077,566, now U.S. Pat. No. 11,246,458, filed Oct. 22, 2020, which is a continuation of U.S. patent application Ser. No. 15/629,512, now U.S. Pat. No. 10,813,508, filed Jun. 21, 2017, which claims the benefit of U.S. Provisional Patent Application No. 62/353,319, filed Jun. 22, 2016, the entire disclosures of which are incorporated herein by reference in their entireties. To the extent appropriate, a claim of priority is made to each of the above disclosed applications.

FIELD OF THE INVENTION

This invention relates to the field of bathroom accessories. More particularly, it relates to wall-mounted bathroom accessories including towel bars, towel rings, and robe hooks.

BACKGROUND OF THE INVENTION

Bathroom accessories are commonly used for convenience to store towels or garments. For example, a typical bathroom includes a wall-mounted towel bar along with a robe hook. Bath towels and hand towels are commonly stored on the towel bar, while robes or additional towels are commonly hung from the robe hook. Therefore, a homeowner typically needs to utilize multiple, wall-mounted bathroom accessories.

In addition to towel bars and robe hooks, many bathrooms are also equipped with other accessories such as soap dishes, soap dispensers, tumbler holders, toothbrush holders, mirrors, and the like. Each one of these bathroom accessories requires an additional fastener to secure the accessory to the bathroom wall. Each fastener creates a hole in the wall and requires time and labor for installation.

Smaller bathrooms have limited, available wall space, thereby making it difficult for homeowners to find multiple places on their walls for each, desired accessory. As a result, many homeowners elect to install only some of their desired accessories and forego the rest. For example, the robe hook is commonly foregone in exchange for the more-popular towel bar, and, thus, when a need arises for a convenient bathroom robe hook, the homeowner is deprived of the robe hook experience.

Furthermore, a homeowner may not install robe hooks in their bathroom because the robe hooks may be seldom-used. A homeowner may not want to clutter a bathroom wall with unused accessories, and, thus, detract from the aesthetic appeal of the wall. As a result, when a need arises for a convenient bathroom robe hook, the homeowner is again deprived of the robe hook experience.

Some homeowners elect to use temporary hooks that attach to the top of a door or suction cup the side of a glass wall. These types of temporary solutions allow the homeowner to easily conceal the hook when not in use, but these solutions offer little utility for heavy items, such as wet towels or large robes, which may cause damage to the door and wall finish.

What is therefore needed is a bathroom accessory that allows a homeowner to minimize the amount of time and holes in the wall necessary for installation of various bathroom accessories. What is further needed is a towel bar and a robe hook that minimizes the amount of wall space necessary for installation of both accessories. Lastly, what is needed is a robe hook that is secured to the wall, yet easily concealable when not in use.

SUMMARY AND OBJECTS OF THE INVENTION

In one embodiment of the present disclosure, a wall-mounted bathroom accessory, such as a towel bar or towel ring, includes a first base configured for attaching to and extending from a wall. A second base may also be attached to the wall horizontally apart from the first base. A first and second receiver in each of the first base and second base, respectively, horizontally oppose one another on a common horizontal plane. The first and second receivers receive a straight and linear bar to form a towel bar. A shaft slidably engages one of a distal ends of the bar and the first base. By sliding, the shaft can extend a distance away from one of the first base as determined by the user, and the bar can also slidingly retract into one of the bar and the first base.

The shaft may be spring-loaded such that it "pops" out of the first base or bar once depressed. The shaft may also have a twisted engagement, such as threaded or bayonet style engagement, with either the base or the bar. The shaft may also extend from any one of the first base, second base, or either end of the bar. A cap on a distal end of the shaft can provide a decorative feature and also provide a stop to prevent an object, such as a hanger, from sliding off of the shaft. The cap extends away from either the first base or the second base when the shaft is extended, and the cap draws towards either the first base or the second base when the shaft is retracted. The shaft may extend and retract perpendicular from the bar or may extend and retract in the same axis as the bar.

In another embodiment, the wall-mounted bathroom accessory may be formed of a first base that attaches to a vertical wall. A first receiver formed in the first base forms an orifice. Either a bar or a ring can be inserted into the orifice of the receiver to form a wall-mounted towel ring. A shaft extends from the first base and manually articulates to a vertical position to form a hook and also manually articulates to a horizontal position to eliminate the hook.

The shaft may extend from and also articulate from either the end of the bar or from the first base.

In either embodiment, the shaft can be retained in an extended or articulated vertical position by a detent to hold it in place.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereinafter with reference to the attached drawings, which are given as non-limiting examples only, in which.

Figure 1:
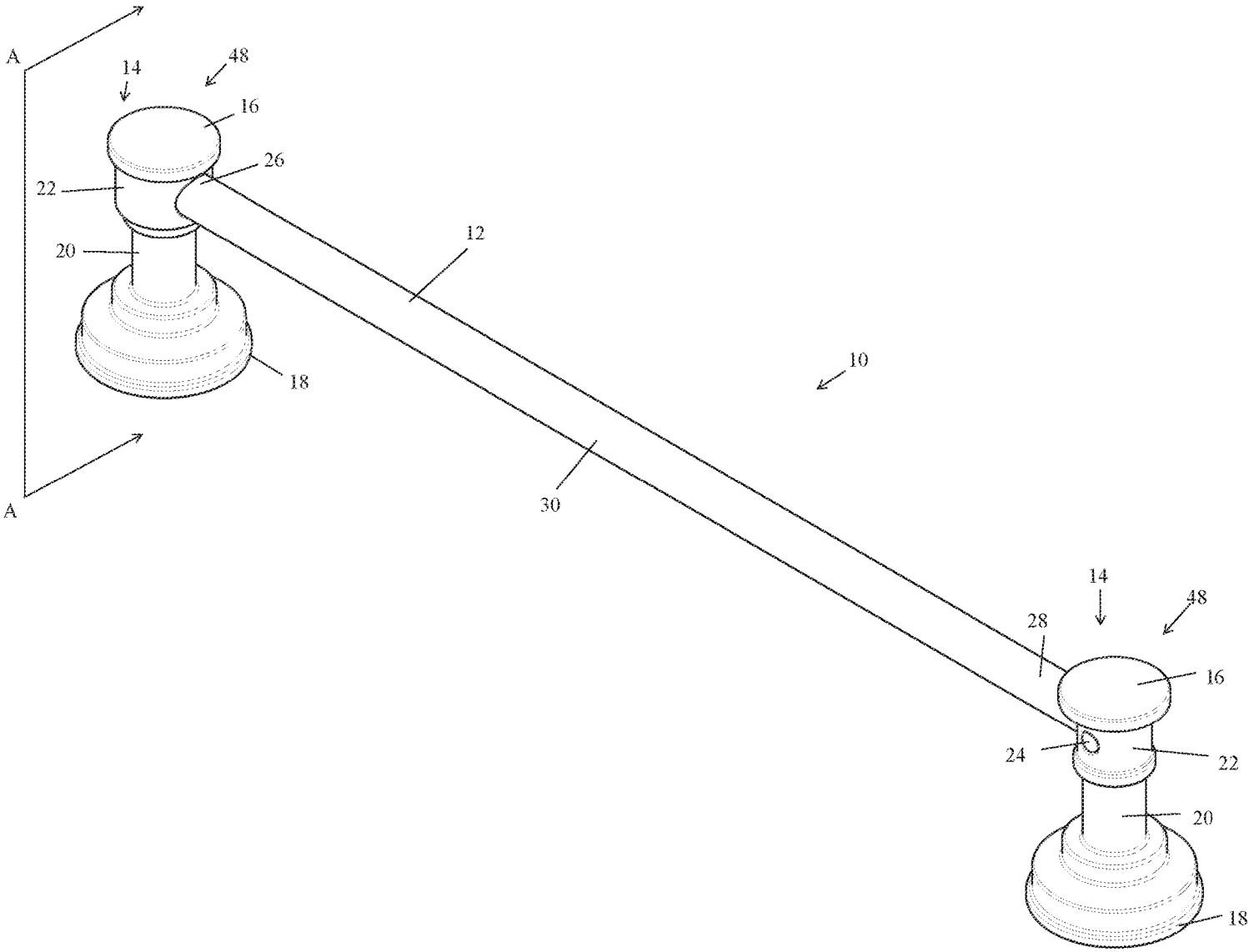
FIG. 1 is a perspective view of a towel bar according to the present invention with robe hooks in a retracted and concealed position.

In the drawings, some structural or method features may be shown in specific arrangements and/or orderings. However, it should be appreciated that such, specific arrangements and/or orderings may not be required. Rather, in some embodiments, such features may be arranged in a different manner and/or order than shown in the illustrative figures attached. Additionally, the inclusion of a structural or methodological feature in a particular figure is not meant to imply that such feature is required in all embodiments and, in some embodiments, may not be included or may be combined with other features.

Corresponding reference characters in the drawings indicate corresponding parts throughout the several views. The exemplification set out herein illustrates embodiments of the invention, and such exemplification is not to be construed as limiting the scope of the invention m any manner.

DETAILED DESCRIPTION

FIG. 1 shows a towel bar 10 according to the invention. The towel bar 10 includes a straight bar 12 that is connected to a base 14 on each distal end 26, 28 of the bar 12. While a straight bar 12 is shown, the bar 12 may be formed in any other shape such as a curved bar. The bar 12 may also be in the form of a ring and require only a single base 14 to support the ring. In such an embodiment, the ring would attach to the base 14 in similar fashion as the bar 12 attaches to the base 14.

The bar 12 is used to support a towel (not shown) or similar article draped over the bar 12 at about a middle portion 30 of the bar 12. The distal ends 26, 28 of the bar 12 are supported by each base 14, respectively. The distal ends 26, 28 of the bar 12 are inserted into a receiver 22. The distal ends 26, 28 may be held within the receivers 22, with either a frictional fit or by attachment of each base 14 to a wall, while the bar 12 is supported by the receivers 22. Alternatively, a set screw 24 may be located in each receiver 22 and tightened to prevent the bar 12 from rotating or otherwise moving to further secure any objects on the bar 12.

Each base 14 includes a pedestal 18 attached to a column 20. The receiver 22 sits atop the column 20. While the pedestal 18, column 20, and receiver 22 are formed into columnar and round shapes, they can be made into polygonal shapes as well. Other polygonal shapes include pyramidal, rectilinear, or abstract shapes. The abstract shapes may mimic things such as water, trees, animals, or any other known object. The overall purpose of the base 14 is simply to support the bar 12 in a position that is offset from the pedestal 18 to accommodate for an object to be hung from the bar 12 at a distance from a wall.

Alternatively, the base 14 may be mounted to a wall without any bar 12. In this configuration, the base 14 would not require a receiver 22. The base 14 can then act as a robe hook with a retractable and extendable extension as described below.

Figure 2:
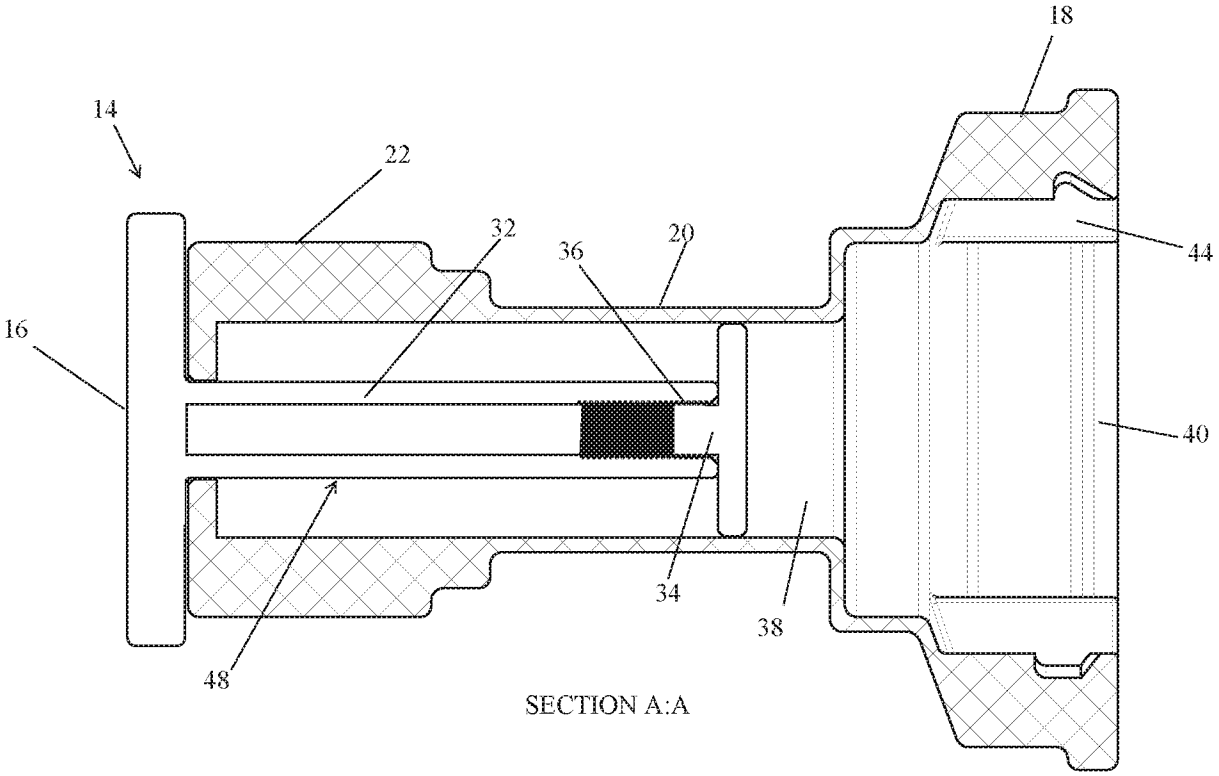
FIG. 2 is a sectional view of a base of the towel bar of FIG. 1 along section line AA with the robe hook in a retracted position.
Figure 3:
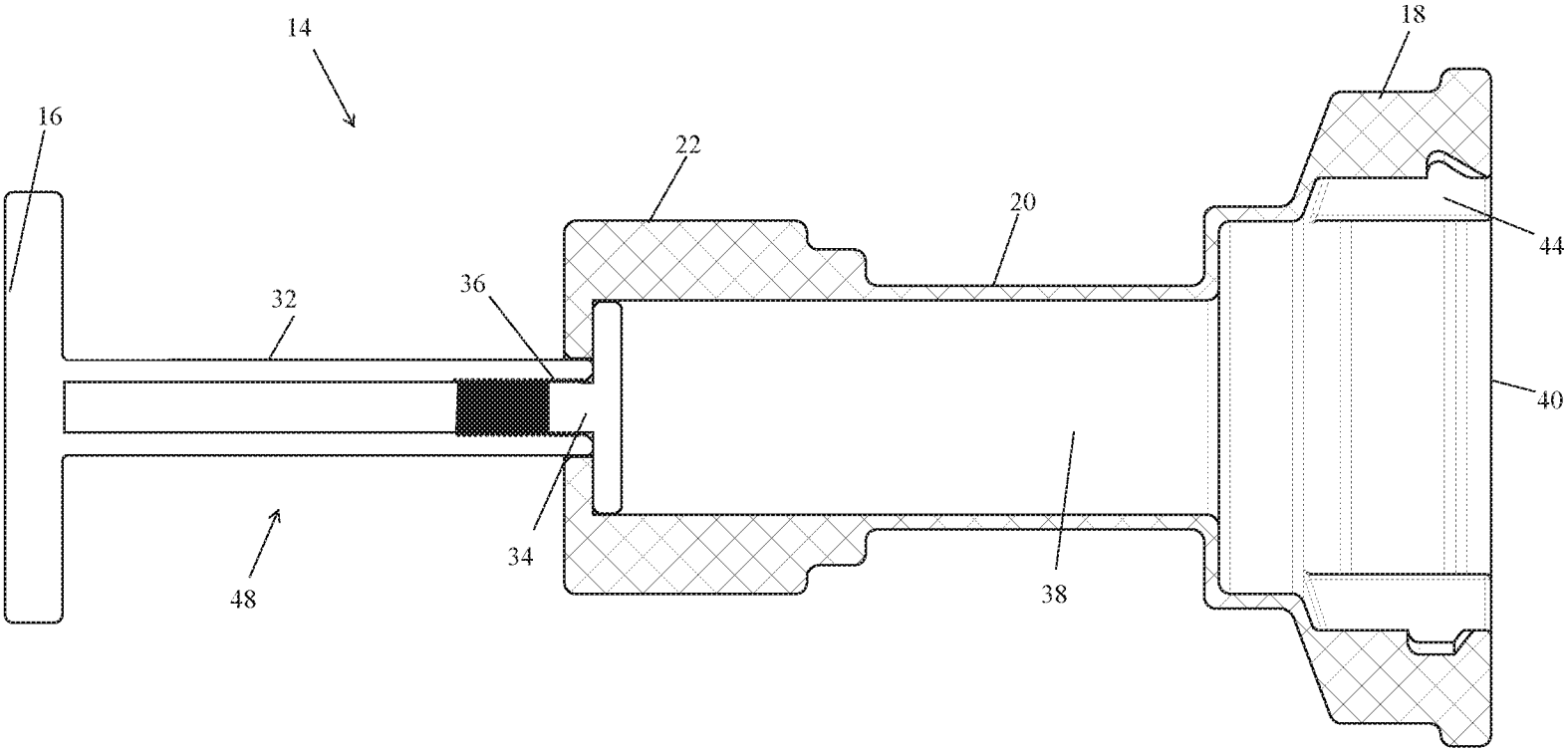
FIG. 3 is a sectional view of the base of FIG. 2, with the robe hook in an extended position.

FIGS. 2 and 3 show a sectional view of the base 14 described above. In the sectional view, the inside of the base 14 is shown with a robe hook 48 in a retracted position within an internal cavity 38 of the base 14. The robe hook 48 is formed by a piston 34 that travels within the internal cavity 38 into a retracted position as shown in FIG. 2, and may be extended into an extended position as shown in FIG. 3.

The piston 34 may be retracted or extended by manipulation of a cap 16 fastened to an end of a shaft 32. In the extended position, as shown in FIG. 3, the piston 34 butts up against the receiver 22 forming a positive stop. In the retracted position, the cap 16 is pressed such that the piston is driven into the internal cavity 38 towards the pedestal 18 until the cap engages the receiver 22. This sliding engagement of the piston 34 and the internal cavity 38 can also be supplemented with a spring within the internal cavity 38. In such a configuration, a spring may be used to urge the piston 34 into the extended position when a user manipulates the cap 16. The spring may be in the form of a compressed coil spring, rubber spring, foam spring, or air spring. The purpose of such a spring is to assist in the extension of the piston into the extended positon when a user activates the robe hook 48 by manipulating the cap 16.

The piston 34 may also be extended with a threaded engagement such that rotating the robe hook 48 in one direction, i.e., counter clockwise, extends the shaft 32 from the internal cavity 38, thereby placing the robe hook 48 in the extended position. Rotating the robe hook 48 in the opposite direction, i.e., clockwise, retracts the shaft 32 back into the internal cavity 38.

Figure 4:
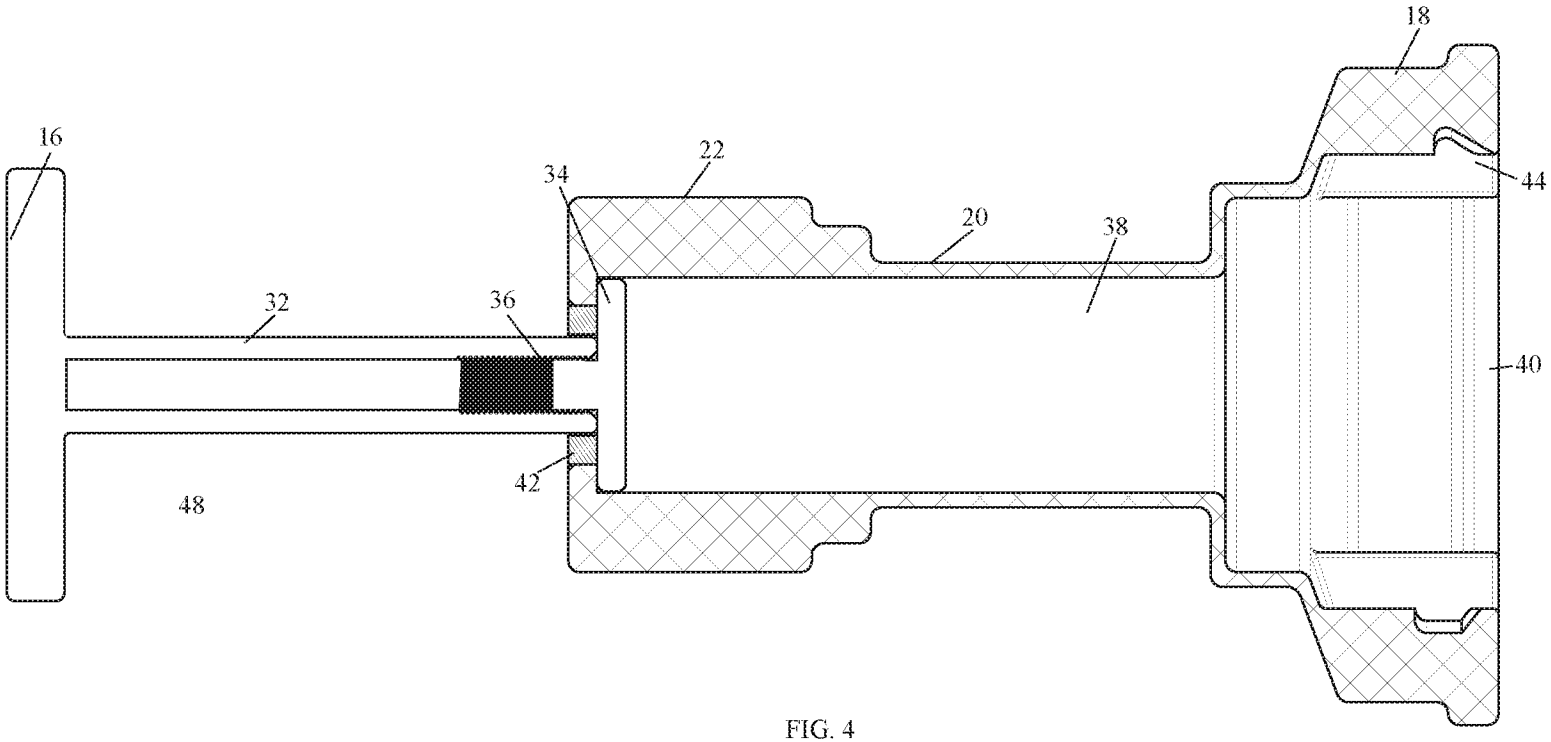
FIG. 4 is a sectional view of the base of FIG. 2, with the robe hook in an extended position with an added support bushing for the extended robe hook.

Preferably, the robe hook 48 is extended and retracted by simply pulling and pushing on the cap 16, respectively. A frictional fit of the piston 34 with the internal cavity 38 may be used to help keep the robe hook 48 in the desired position. A bushing 42, as shown in FIG. 4, may also be used to help stabilize the shaft 32 as it is pushed or extended into and from the internal cavity 38. The bushing 42 may either add friction to the sliding engagement of the shaft 32 or reduce the frictional fit.

When installing the base 14 to a wall, first, a retainer 44 may be secured. The piston 34 may be inserted into the internal cavity through access 40 in the pedestal 18. A threaded engagement 36 may be used to attach the piston 34 to the shaft 32. This assembly technique may also be used to manufacture the base 14. After the piston 34 is threaded to the shaft 32, the pedestal may be secured to the wall-mounted retainer 44 (see FIG. 2 for example). The retainer 44 may be used to conceal the use of any fasteners as the fasteners are hidden from view.

As shown in FIG. 1, after a first base 14 is attached to a wall with a retainer 44, the distal end 26 of the bar 12 may be inserted into the receiver 22. The opposing distal end 28 of the bar 12 may then be inserted into the receiver 22 of a second base 14. The second base 14 may then be attached to the wall in similar fashion, thereby securing the towel bar 10 to the wall.

Figure 5:
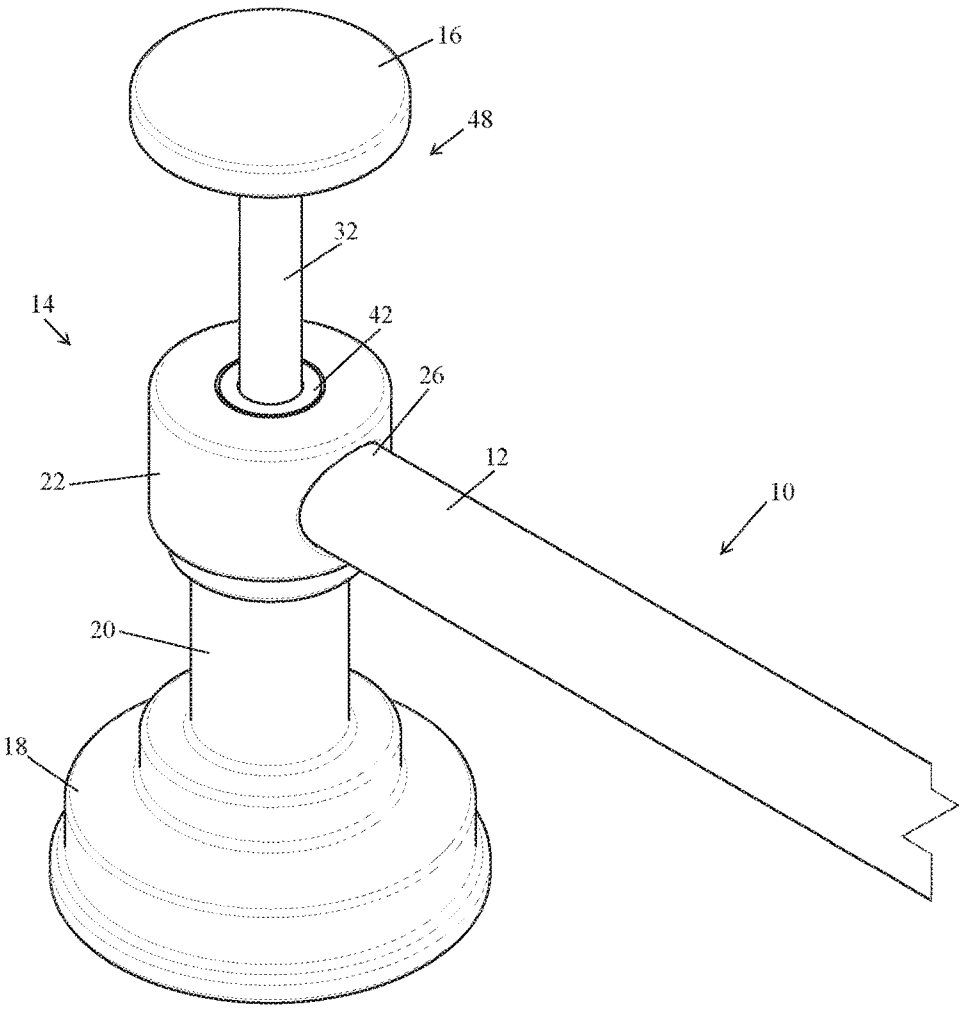
FIG. 5 is a perspective view of a towel bar with a robe hook in the extended position.
Figure 6:
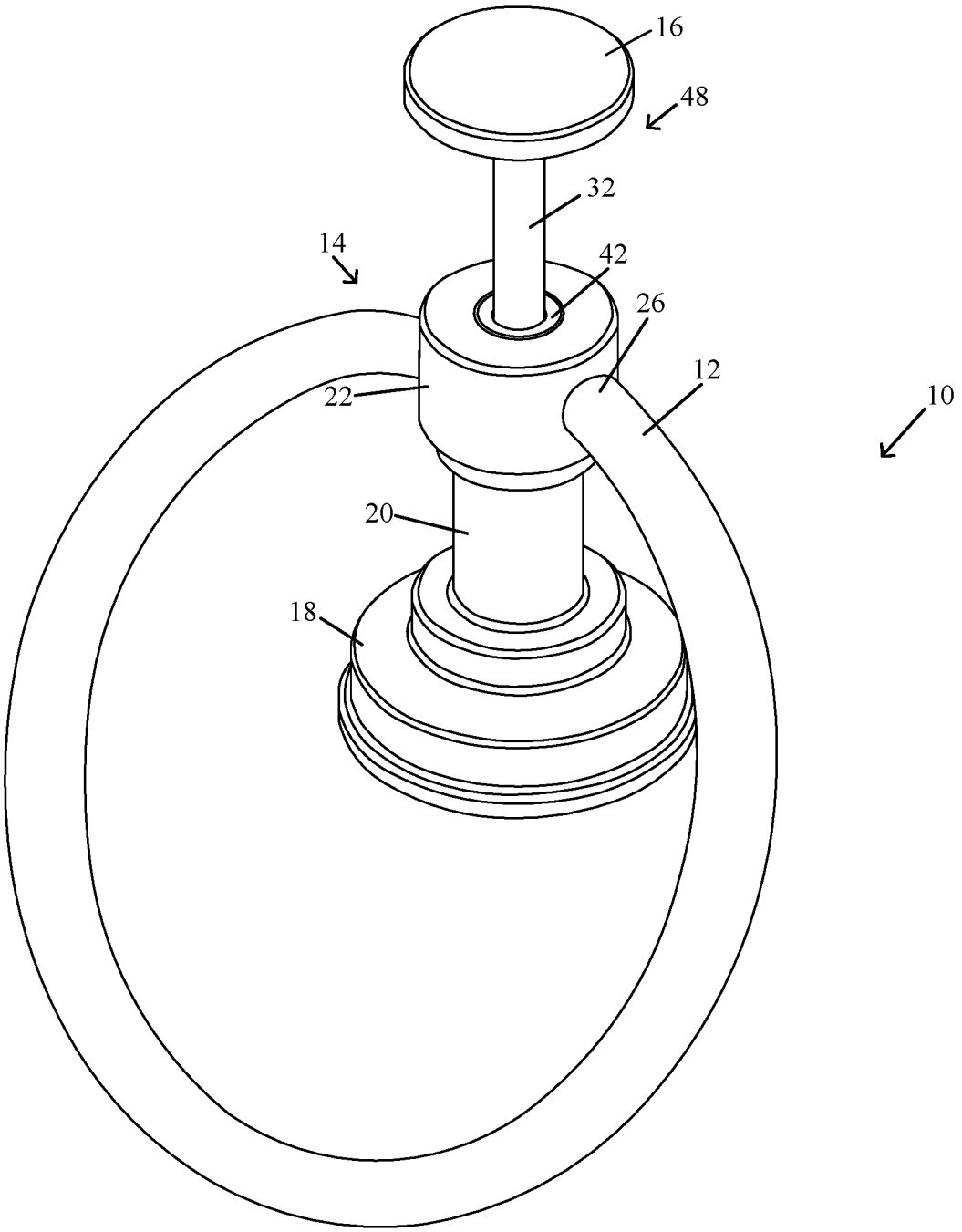
FIG. 6 is a perspective view of a towel bar with the robe hook of FIG. 5 in the extended position.

Looking to FIG. 5, the robe hook 48 is shown with the cap 16 and shaft 32 in the extended position. Once extended, the shaft may support an object such as a hanger, and the cap 16 may support a hung garment or towel.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well-known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments, whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

We claim:

1. A wall-mounted accessory comprising:

a base including:

a first end configured to fixedly attach to a surface of a wall;

an opposite second end configured to be positioned at a distance from the wall, the first end and the second end defining a longitudinal axis, the longitudinal axis orthogonal to the wall when the base is attached thereto; and an internal cavity defined within the base and extending along the longitudinal axis between the first end and the second end;

a shaft slidably coupled to the second end of the base and extending along the longitudinal axis, the shaft including a first end and an opposite second end, the second end including a piston captured within the internal cavity, wherein the shaft is configured to move between at least an extended position whereby the first end of the shaft is extended relative to the second end of the base and a retracted position whereby the first end of the shaft is positioned adjacent the second end of the base, and wherein the piston of the second end of the shaft is disposed within the internal cavity of the base when the shaft is in both the extended position and the retracted position, the piston preventing the shaft from being removed from the second end of the base; and a bushing surrounding the shaft and supported on the second end of the base, wherein when the shaft is in the extended position, the piston abuts the bushing and the second end of the base in an axial direction and forming a positive stop so as to define a maximum extension distance of the first end of the shaft relative to the second end of the base.

2. The wall-mounted accessory of claim 1, wherein the piston is frictionally engaged within the internal cavity.

3. The wall-mounted accessory of claim 1, wherein the shaft is spring loaded.

4. The wall-mounted accessory of claim 1, further comprising a retainer configured to secure to the surface of the wall, the retainer received within the internal cavity of the base at the first end to fixedly attach the first end to the surface of the wall.

5. The wall-mounted accessory of claim 1, wherein the first end of the shaft includes a cap.

6. The wall-mounted accessory of claim 5, wherein the cap is circular in shape.

7. The wall-mounted accessory of claim 1, wherein the second end of the base is configured to couple to a straight towel bar or a curved towel bar.

8. The wall-mounted accessory of claim 1, wherein the second end of the base defines a receiver for a towel bar.

9. The wall-mounted accessory of claim 1, wherein the base acts a robe hook.

10. A wall-mounted accessory comprising:

a base including:

a pedestal configured to fixedly attach to a surface of a wall;

an opposite distal end configured to be positioned at a distance from the wall, the pedestal and the distal end defining a longitudinal axis, the longitudinal axis orthogonal to the wall when the base is attached thereto; and an internal cavity defined within the base and extending along the longitudinal axis between the pedestal and the distal end;

a shaft slidably coupled to the distal end of the base and extending along the longitudinal axis, the shaft including a first end and an opposite second end, the second end including a piston captured within the internal cavity, wherein the shaft is configured to move between at least an extended position whereby the first end of the shaft is extended relative to the distal end of the base and a retracted position whereby the first end of the shaft is positioned adjacent the distal end of the base, and wherein the piston of the second end of the shaft is disposed within the internal cavity of the base when the shaft is in both the extended position and the retracted position, the piston preventing the shaft from being removed from the distal end of the base;

a bushing surrounding the shaft and supported on the distal end of the base, wherein when the shaft is in the extended position, the piston abuts the bushing and the distal end of the base in an axial direction and forming a positive stop so as to define a maximum extension distance of the first end of the shaft relative to the distal end of the base; and a retainer configured to secure to the surface of the wall, the retainer at least partially received within the internal cavity of the base at the pedestal to fixedly attach the pedestal to the surface of the wall.

11. The wall-mounted accessory of claim 10, wherein the piston is a spring loaded piston.

12. The wall-mounted accessory of claim 11, wherein the shaft is biased towards the extended position.

13. The wall-mounted accessory of claim 12, wherein the shaft is retained in the extended position by a detent.

14. The wall-mounted accessory of claim 10, wherein the shaft includes a robe hook.

15. The wall-mounted accessory of claim 10, wherein the shaft is manually moveable between the extended position and the retracted position.

16. The wall-mounted accessory of claim 10, wherein the distal end of the base is configured to couple to a straight towel bar or a curved towel bar.

17. The wall-mounted accessory of claim 10, wherein the distal end defines a receiver for a towel bar.

18. The wall-mounted accessory of claim 10, wherein the base acts as a robe hook.

19. The wall-mounted accessory of claim 1, wherein the piston is attached to the shaft via a threaded engagement.

20. The wall-mounted accessory of claim 10, wherein the piston is attached to the shaft via a threaded engagement.

* * * * *